United States Patent [19]

Ishizuka

[11] 4,392,416

[45] Jul. 12, 1983

[54] SWASH-PLATE TYPE COMPRESSOR HAVING LOW NOISE THRUST BEARINGS

[75] Inventor: Yutaka Ishizuka, Konan, Japan

[73] Assignee: Diesel Kiki Co., Ltd., Tokyo, Japan

[21] Appl. No.: 258,008

[22] Filed: Apr. 27, 1981

[30] Foreign Application Priority Data

May 10, 1980 [JP] Japan ..... 55-61935

[51] Int. Cl.[3] ..... F04B 1/16; F04B 1/18

[52] U.S. Cl. ..... 92/71; 417/269

[58] Field of Search ..... 417/269; 91/486, 505; 92/71

[56] References Cited

U.S. PATENT DOCUMENTS

| | | | |
|---|---|---|---|
| 3,257,960 | 6/1966 | Keel | 91/481 |
| 3,635,126 | 1/1972 | Engel | 91/505 |
| 3,721,161 | 3/1973 | Bobst | 91/486 |
| 3,862,588 | 1/1975 | Bahrle | 91/486 |

FOREIGN PATENT DOCUMENTS

| | | | |
|---|---|---|---|
| 54-47910 | 10/1979 | Japan | 417/269 |

*Primary Examiner*—William L. Freeh

*Attorney, Agent, or Firm*—Frishauf, Holtz, Goodman and Woodward

[57] ABSTRACT

A swash-plate type compressor provided with a pair of thrust bearings arranged at opposite ends of the swash plate to support thrust loads caused by the swash plate. The thrust bearings each comprise a plurality of seats in the form of blind holes formed in end faces of central seating portions formed on the cylinder blocks and a plurality of bearing members each having its one end portion slidably fitted in a corresponding one of the seats. The seats or blind holes are formed in the end face of each central seating portion along the perimeter of the opening of a drive shaft-fitted axial hole formed in the central seating portion and in a circumferentially spaced arrangement. The bearing members each have its other end portion formed with a planar end face and have this planar end face disposed in slidable face-to-face contact with a corresponding end face of the boss of the swash plate.

10 Claims, 6 Drawing Figures

SWASH-PLATE TYPE COMPRESSOR HAVING LOW NOISE THRUST BEARINGS

BACKGROUND OF THE INVENTION

This invention relates to a swash-plate compressor provided with novel bearing means for supporting thrust loads caused by the swash plate.

A swash-plate type compressor in general is constructed such that a swash plate is rigidly fitted on the drive shaft of the compressor in a slanted fashion and engages at its fringe portion with pistons received within cylinder bores, whereby rotation of the swash plate causes the pistons to make reciprocating motions within the cylinder bores to compress compression medium and discharge same.

Conventional swash-plate type compressors of this kind include a type that the drive shaft is inserted in axial through bores formed in two cylinder blocks combined together in axial alignment, a swash plate chamber being defined between the combined cylinder blocks, within which a swash plate is arranged, while the swash plate is fitted aslant on the drive shaft. According to this type, the drive shaft is supported by radial bearings in the radial directions at radial bearing portions provided within the axial through bores, while supported in the axial or thrust-applying directions by thrust bearings at opposite sides of the swash palte.

The above thrust bearings are usually formed of needle bearings which are interposed between the end faces of the central seating portions of the combined cylinder blocks and the end faces of the boss of the swash plate for supporting thrust loads caused by rotation of the swash plate. These needle bearings, however, have a structural drawback that they produce large noise during rotation of the swash plate. Moreover, the needle bearings are expensive, like needle bearings in general.

To avoid the above drawbacks in the needle bearings, it has been proposed to interpose thrust plane bearings each formed of an annular plate member having substantially the same diameter as those of the central seating portions of the cylinder blocks, which are interposed between the end faces of the central seating portions of the cylinder blocks and the end faces of the boss of the swash plate. However, the load distribution can be uneven over the bearing surface when the swash plate is axially angularly displaced from its usual or proper position during its rotation, resulting in a large amount of abrasion of the bearing surface. This shortens the effective life of the bearing. Therefore, thrust plane bearings are not suitable for use in the above-mentioned type compressor, either. Such being the circumferences, thrust needle bearings are still used in the above-mentioned type compressor.

OBJECTS AND SUMMARY OF THE INVENTION

It is an object of the invention to provide a swash-plate type compressor which is provided with thrust bearings having a novel construction with very small operating noise, interposed between the end faces of the central seating portions of the cylinder blocks and the opposite end faces of the boss of the swash plate.

It is another object of the invention to provide a swash-plate type compressor provided with thrust bearings which are excellent in durability, simple in structure and low in cost.

According to the invention, there is provided a swash-plate type compressor which comprises a pair of thrust bearings arranged at opposite ends of a swash plate for supporting thrust loads caused by the swash plate, the thrust bearings each comprising a plurality of seats, each being in the form of a blind hole, the seats being formed in the end face of a corresponding one of central seating portions formed on a pair of combined cyclinder blocks and arranged around a corresponding one of axial holes formed in the combined cylinder blocks and in circumferentially spaced relation, and a plurality of bearing members corresponding in number to the above seats, the bearing members each having one end portion thereof slidably fitted in a corresponding one of the seats. The seats each have a hole shape corresponding to the shape of the above one end portion of a corresponding one of the bearing members. The bearing members each have another end formed with a planar end face, and have this planar end face disposed in slidable contact with an associated end face of the boss of the swash plate.

The above and other objects, features and advantages of the invention will be more apparent from the ensuing detailed description taken in connection with the accompanying drawings in which:

DETAILED DESCRIPTION

Figure 1:
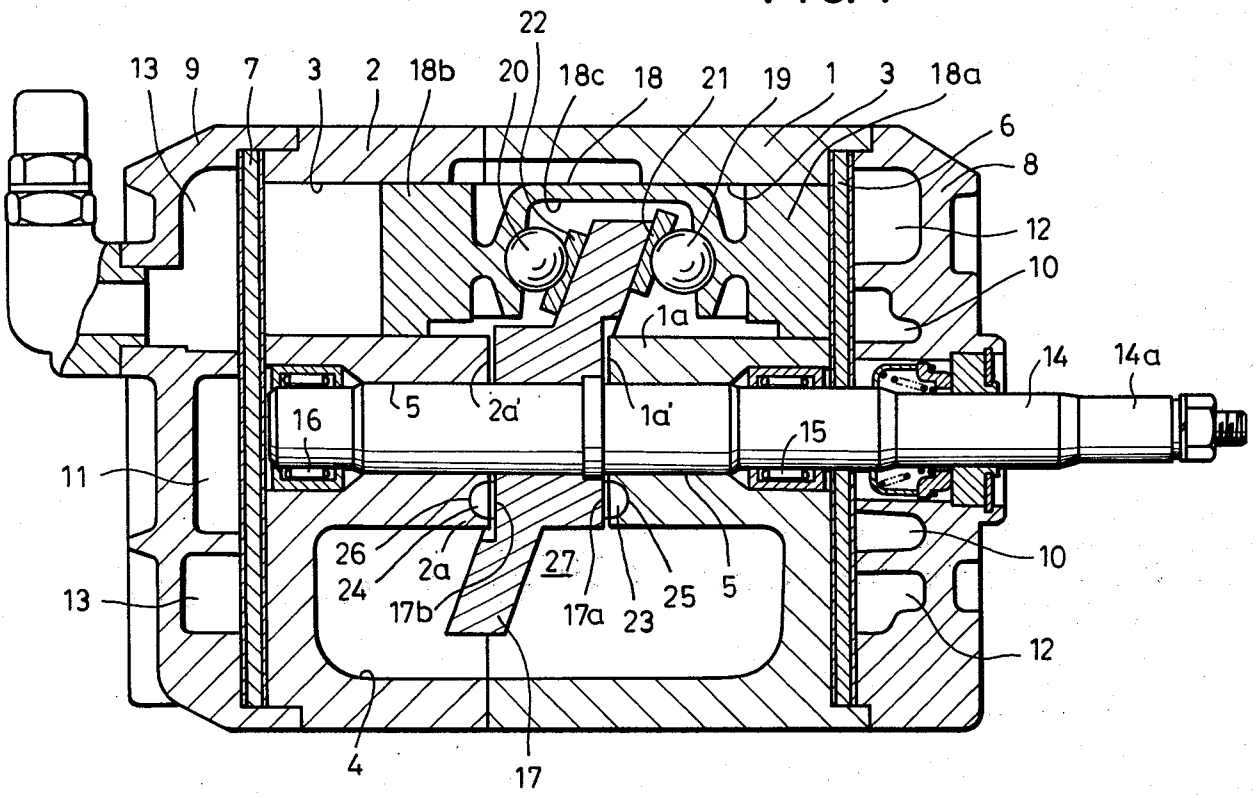
FIG. 1 is a longitudinal vertical sectional view of a swash-plate type compressor according to an embodiment of the invention.
Figure 2:
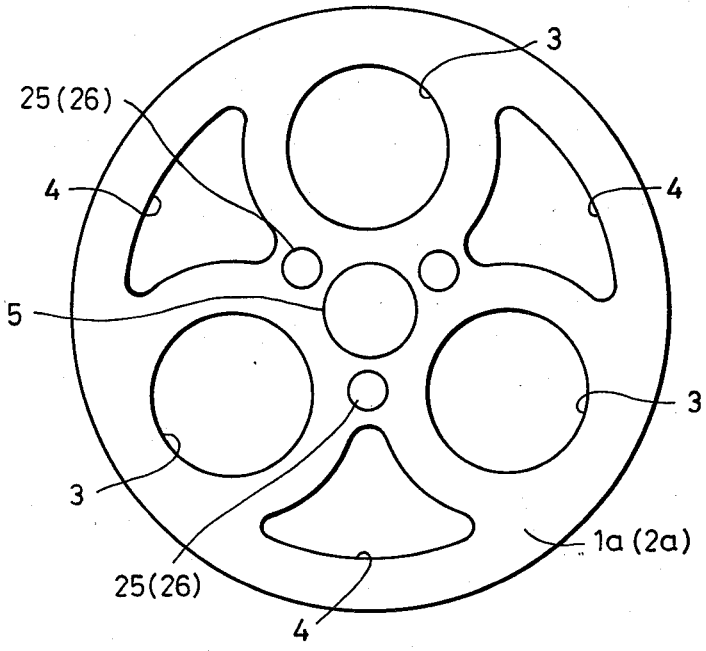
FIG. 2 is an end view of one of the cylinder blocks shown in FIG. 1, as viewed from the joining side of the cylinder block.
Figure 3:
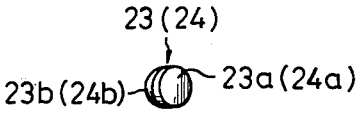
FIG. 3 is a perspective view of a bearing member used in the construction of FIG. 1.

Referring now to the drawings, wherein like reference numerals designate like or corresponding parts throughout all the views, FIGS. 1 through 3 illustrate a swash-plate type compressor according to a first embodiment of the present invention. Two cylinder blocks 1, 2 are combined together at their inner ends in axial alignment. These combined cylinder blocks 1, 2 are formed with three cylinder bores 3 axially extending therethrough and circumferentially arranged at equal intervals. Three chambers 4 are formed in the combined cylinder blocks 1, 2, each of which is located between adjacent ones of the cylinder bores 3. The upper two of the chambers 4 serve, respectively, as a discharge passage and a suction passage for compression medium, and the lower one is used as a lubricating oil reservoir which is in communication with a swash plate chamber 27 formed between the cylinder blocks 1, 2.

Axial bores 5 are also formed in the combined cylinder blocks 1, 2 which extend along the common axis of the cylinder blocks 1, 2.

Front and rear cylinder heads 8, 9 are provided at outer opposite ends of the combined cylinder blocks 1, 2 with valve plates 6, 7 intervening therebetween. The valve plates 6, 7 and the cylinder heads 8, 9 are secured integrally to the cylinder blocks 1, 2 by means of bolts, not shown, or the like. The cylinder heads 8, 9 are each formed with a suction chamber 10, 11, and a delivery chamber 12, 13 which chambers communicate with the cylinder bores 3, respectively, through suction valves and discharge valves, not shown, the valves being mounted on the valve plates 6, 7.

A drive shaft 14 is inserted in the axial bores 5 formed in the cylinder blocks 1, 2 and rotatably supported by radial needle bearings 15, 16. The drive shaft 14 has its right end portion extending through the valve plate 6 and the cylinder head 7 and projected to the outside, the projected portion being formed as a mounting portion 14*a* on which a magnetic clutch, not shown, is mounted for transmitting driving force to the drive shaft 14.

A swash plate 17 is secured on the drive shaft 14 with a certain inclination, for rotation in unison with the rotation of the drive shaft 14.

Three pistons 18 (only one of them is shown) are slidably received within the cylinder bores 3, which are double-acting pistons, each having a pair of sliding heads 18*a*, 18*b* formed at its opposite ends. The pistons 18 are each formed at its central portion with a recess 18*c* radially inwardly opening, in which the fringe portion of the swash plate 17 is engaged at its opposite sides by means of balls 19, 20 and shoes 21, 22 so that the pistons 18 are reciprocatingly moved within the respective cylinder bores 3 as the swash plate 17 is rotated. Thrust loads, which are produced due to the compressing action of the pistons 18, are supported by bearing members 23, 24 which are interposed, respectively, between the opposite end faces 17*a*, 17*b* of the boss of the swash plate 17 and the end faces 1*a*', 2*a*' of central seating portions 1*a*, 2*a* formed on the inner end portions of the cylinder blocks 1, 2. The bearing members 23, 24 are each generally semispherical in shape, with its one end formed with a planar end face 23*a*, 24*a* and its other end portion formed as a semispherical portion 23*b*, 24*b*, as well shown in FIG. 3. These bearing members 23, 24 have their semispherical portions 23*b*, 24*b* slidably fitted in seating holes 25, 26 in the form of blind holes, formed, respectively, in the end faces 1*a*', 2*a*' of the central seating portions 1*a*, 2*a* of the cylinder blocks 1, 2, and have their end faces 23*a*, 24*a* disposed in slidable urging face-to-face contact with the end faces 17*a*, 17*b* of the boss of the swash plate 17, respectively. The bearing members 23, 24 may advantageously be formed of a metal or an alloy which is generally not apt to cohere to the surfaces of the swash plate 17 which is usually made of cast iron, thus to reduce the possibility of seizure of the members 23, 24. Such metal or alloy may include aluminum, iron, copper, or an alloy thereof, preferably aluminum, an alloy thereof, an iron base sintered alloy or phosphor bronze. If the swash plate is formed of aluminum or an alloy thereof, the bearing members 23, 24 may be formed of a ferrous metal or an alloy thereof.

The two groups of seating holes 25, 26 are formed in the end faces 1*a*', 2*a*' of the central seating portions 1*a*, 2*a* along the perimeters of the openings of the axial holes 5 opening in the above end faces 1*a*', 2*a*', of the central seating portions 1*a*, 2*a*, respectively. The seating holes 25, 26 in each group are each located between adjacent ones of the cylinder bores 3 and are circumferentially arranged at equal intervals. These holes 25, 26 each have a semispherical shape corresponding to that of the semispherical portion 23*b*, 24*b* of the bearing member 23, 24.

The operation of the swash-plate type compressor provided with the thrust bearings constructed above will now be described. When the swash plate 17 is rotated in unison with the rotation of the drive shaft 14, the pistons 18 are reciprocatingly moved to cause the compression medium in the suction chambers 10, 11 within the cylinder heads 8, 9 to be sucked into the cylinder bores 3 through the valve plates 6, 7, compressed therein and discharged into the delivery chambers 12, 13 through the valve plates 6, 7, thus carrying out compression and discharge actions.

As previously mentioned, the drive shaft 14 is rotatably supported by the radial bearings 15, 16, while the thrust loads caused by the rotation of the swash plate 17 are supported by the bearing members 23, 24. The bearing members 23, 24, which support the swash plate 17 in the axial directions, while disposed in sliding contact therewith, rotate in the respective seating holes 25, 26 as the swash plate 17 is rotated, which results in even abrasion of the planar end faces 23*a*, 24*a* of the bearing members 23, 24 over their entire areas.

Furthermore, since their semispherical portions 23*b*, 24*b* are slidable in their respective seating holes 25, 26, the bearing members 23, 24 can be angularly displaced in unison with tilting of the swash plate 17 during rotation so that the planar end faces 23*a*, 24*a* can have their entire surfaces always kept in close contact with the opposite end faces of the swash plate 17, further enhancing the evenness of the abrasion of the end faces 23*a*, 24*a*.

Figure 4:
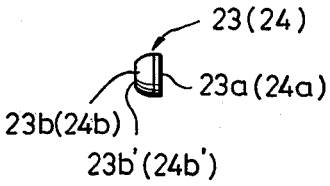
FIG. 4 is a side view showing another embodiment of the bearing member.

In place of the bearing members 23, 24 illustrated in FIGS. 1 and 3, those bearing members may be used which have semispherical portions 23*b*, 24*b* with their tips diametrically cut off to form planar tip surfaces 23*b*', 24*b*', as shown in FIG. 4.

Figure 5:
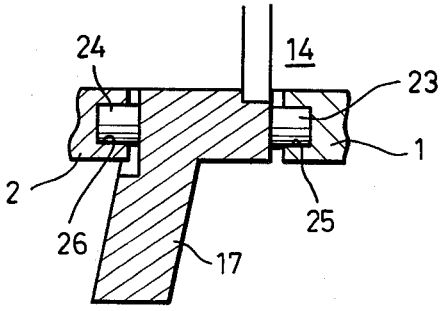
FIG. 5 is a fragmentary sectional view of a further embodiment of the bearing member and its associated seating hole formed in a corresponding one of the cylinder blocks.
Figure 6:
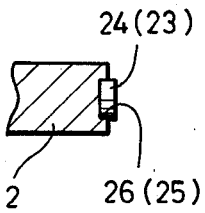
FIG. 6 is a fragmentary view of still another embodiment of the bearing member and its associated hole.

Moreover, bearing members 23, 24 with the semispherical portions 23*b*, 24*b* omitted may be used in the case that the swash plate 17 is substantially free from angular displacement or tilting or undergoes a very small amount of such tilting during rotation. In such a case, the bearing members 23, 24 may be each formed of a cylindrical body as illustrated in FIG. 5 or a disc-like body as illustrated in FIG. 6. If bearing members 23, 24 as illustrated in FIGS. 5 and 6 are used, seating holes 25, 26 are used which have shapes corresponding to the associated end portions of the bearing members which are to be fitted in such holes.

As will be understood from the foregoing description, the bearing members according to the invention are simple in structure as compared with conventional thrust needle bearings, and low in manufacturing cost. The noise produced by these bearing members during rotation of the swash plate is much smaller as compared with conventional thrust needle bearings. Furthermore, the seating holes for receiving therein the bearing members, if formed in spaces between adjacent cylinder bore openings in the end faces of the cylinder blocks, can be designed large in diameter, which in turn makes it possible to design the associated bearing members as large in diameter as the large seating holes. Thus, the thrust bearing according to the invention can have an increased capacity of supporting thrust loads.

Obviously many modifications and variations of the present invention are possible in the light of the above teachings. It is therefore to be understood that within the scope of the appended claims the invention may be practiced otherwise than as specifically described.

What is claimed is:

1. In a swash-plate type compressor including: a pair of cylinder blocks combined together in axial alignment, said combined cylinder blocks each having an axial hole extending along an axis thereof and a plurality of cylinder bores axially extending therethrough in circumferentially spaced relation; a drive shaft inserted in said axial holes of said cylinder blocks; a plurality of pistons slidably received within respective ones of said cylinder bores; and a swash plate engaging with said pistons and rigidly fitted at a boss thereof on said drive shaft, said boss having opposite end faces, each of said opposite end faces being substantially flat and extending substantially straight and substantially radially of said drive shaft over a substantially whole area thereof, said combined cylinder blocks having a pair of central seating portions facing opposite said end faces of said boss of said swash plate, said central seating portions having end faces facing said end faces of said boss, each of said end faces of said central seating portions being substantially flat and extending substantially straight and substantially radially of said drive shaft over a substantially whole area thereof, said axial holes of said cylinder blocks opening in end faces of respective ones of said central seating portions facing said swash plate;

the improvement comprising a pair of thrust bearings arranged at opposite ends of said swash plate for supporting thrust loads caused by said swash plate, said pair of thrust bearings each comprising:

a plurality of seats, each seat being in the form of a blind hole, said seats being formed in the substantially flat end face of a corresponding one of said central seating portions and arranged around a corresponding one of said axial holes and in circumferentially spaced relation; and a plurality of bearing members corresponding in number to said seats, said bearing members each having no fluid passage formed therein and each having one end portion thereof slidably fitted in a corresponding one of said seats;

said seats each having a hole shape corresponding to the shape of said one end portion of a corresponding one of said bearing members for receiving a corresponding one of said bearing members therein;

said bearing members each having another formed with an end face being substantially planar over a substantially whole area thereof such that said substantially planar end faces of said another ends of said bearing members have no recess formed therein, said bearing members each having said substantially planar end face thereof disposed in slidable contact with an associated end face of said boss of said swash plate along a substantially whole area thereof; and said end faces of said boss of said swash plate being slightly spaced by said bearing members from said opposite end faces of said central seating portions of said combined cylinder blocks.

2. The swash-plate type compressor as claimed in claim 1, wherein said seats of said thrust bearings are each in the form of an entirely blind hole.

3. The swash-plate type compressor as claimed in claim 1, wherein said bearing members of said thrust bearings each have an entirely solid structure.

4. The swash-plate type compressor as claimed in claim 1, wherein said seats of said thrust bearings are each in the form of an entirely blind hole, and said bearing members of said thrust bearings each have an entirely solid structure.

5. The swash-plate type compressor as claimed in claim 1, wherein said bearing members of said thrust bearings each comprise a generally semispherical body having a semipherical end portion.

6. The swash-plate type compressor as claimed in claim 1, wherein said bearing members of said thrust bearings each have a semipherical end portion having a tip thereof formed as substantially flat end face.

7. The swash-plate type compressor as claimed in claim 1, wherein said bearing members of said thrust bearings each comprise a cylindrical body.

8. The swash-plate type compressor as claimed in claim 1, wherein said bearing members of said thrust bearings each comprise a disc-shaped body.

9. The swash-plate type compressor as claimed in any one of claims 1, 5 through 8, wherein said bearing members of said thrust bearings are formed of one selected from the group consisting of aluminum, iron, copper, and an alloy thereof.

10. The swash-plate type compressor as claimed in any one of claims 1, 5 through 8, wherein said seats formed in said end face of said corresponding one of said central seating portions of said cylinder blocks are each circumferentially located between adjacent ones of said cylinder bores.

* * * * *

UNITED STATES PATENT AND TRADEMARK OFFICE

CERTIFICATE OF CORRECTION

PATENT NO. : 4,392,416

DATED : July 12, 1983

INVENTOR(S) : Yutaka ISHIZUKA

It is certified that error appears in the above-identified patent and that said Letters Patent is hereby corrected as shown below:

Column 5, line 45, after "another", insert --end--.

Signed and Sealed this

*Fifteenth* Day of *November 1983*

[SEAL]

*Attest:*

GERALD J. MOSSINGHOFF

*Attesting Officer*

*Commissioner of Patents and Trademarks*